US009224322B2

(12) United States Patent
Martellaro et al.

(10) Patent No.: US 9,224,322 B2
(45) Date of Patent: Dec. 29, 2015

(54) VISUALLY PASSING DATA THROUGH VIDEO

(75) Inventors: John A. Martellaro, Arlington, VA (US); Brian Ballard, Herndon, VA (US); Jeffrey E. Jenkins, Clarksburg, MD (US)

(73) Assignee: APX LABS INC., Herndon, VA (US)

( * ) Notice: Subject to any disclaimer, the term of this patent is extended or adjusted under 35 U.S.C. 154(b) by 111 days.

(21) Appl. No.: 13/566,573

(22) Filed: Aug. 3, 2012

(65) Prior Publication Data

US 2014/0035951 A1 Feb. 6, 2014

(51) Int. Cl.
*G09G 3/00* (2006.01)

(52) U.S. Cl.
CPC ..... *G09G 3/003* (2013.01); *G09G 2360/18* (2013.01)

(58) Field of Classification Search
USPC ..... 345/633
See application file for complete search history.

(56) References Cited

U.S. PATENT DOCUMENTS

| | | | | |
|---|---|---|---|---|
| 4,969,041 | A * | 11/1990 | O'Grady et al. | 348/473 |
| 7,814,122 | B2 | 10/2010 | Friedrich et al. | |
| 8,374,383 | B2 * | 2/2013 | Long et al. | 382/100 |
| 8,451,266 | B2 * | 5/2013 | Hertenstein | 345/419 |
| 8,913,171 | B2 * | 12/2014 | Roberts et al. | 348/333.02 |
| 2007/0002077 | A1 * | 1/2007 | Gopalakrishnan | 345/619 |
| 2007/0242852 | A1 * | 10/2007 | Kumoluyi | 382/100 |
| 2008/0209062 | A1 | 8/2008 | Barrett | |
| 2010/0208033 | A1 * | 8/2010 | Edge et al. | 348/46 |
| 2011/0134108 | A1 * | 6/2011 | Hertenstein | 345/419 |
| 2011/0164163 | A1 | 7/2011 | Billbrey et al. | |
| 2011/0199479 | A1 | 8/2011 | Waldman | |
| 2012/0022924 | A1 | 1/2012 | Runnels et al. | |
| 2012/0069051 | A1 * | 3/2012 | Hagbi et al. | 345/633 |
| 2012/0206322 | A1 * | 8/2012 | Osterhout et al. | 345/8 |
| 2013/0147686 | A1 * | 6/2013 | Clavin et al. | 345/8 |
| 2014/0063055 | A1 * | 3/2014 | Osterhout et al. | 345/633 |

* cited by examiner

*Primary Examiner* — M Good Johnson
(74) *Attorney, Agent, or Firm* — Dentons US LLP

(57) ABSTRACT

A method and a system involve the insertion of digital data into a number of video frames of a video stream, such that the video frames contain both video content and the inserted digital data. The video, including the inserted digital data is then visually conveyed to and received by an augmented reality device without the use of a network connection. In the augmented reality device, the digital data is detected, processed and used to provide computer-generated data and/or information. The computer-generated data and/or information is then presented on a display associated with the augmented reality device or otherwise reproduced through the augmented reality device, where the computer-generated data and/or information supplements the video content so as to enhance the viewing experience of the augmented reality device user.

34 Claims, 7 Drawing Sheets

VISUALLY PASSING DATA THROUGH VIDEO

FIELD OF THE INVENTION

The present invention relates to methods and systems for conveying digital data. More specifically, the present invention relates to methods and systems for visually conveying digital data through video in an augmented reality environment.

BACKGROUND OF THE INVENTION

Augmented reality, in general, involves augmenting one's view of and interaction with the real world environment with graphics, video, sound and/or other forms of computer-generated information. Augmented reality requires the use of an augmented reality device, which receives information from the physical, real world environment, processes the received information and, based on the processed information, presents the aforementioned graphics, video, sound and/or other computer-generated information in such a way that what the user experiences an integration of the physical, real world and the computer-generated information through the augmented reality device.

Often times, the physical, real world information received by the augmented reality device is only available over an active network connection, such as a cellular, WiFi, Bluetooth network or tethered Ethernet connection. If a network connection is not available, or use thereof is undesirable (for example, use of a network connection would be cost prohibitive), the augmented reality device will be unable to receive the physical, real world information and, in turn, unable to provide the user with the resulting video, sound and/or other computer-generated information necessary for the augmented reality experience.

There are, of course, other ways of conveying and receiving digital information. One such way is to convey and receive digital information visually. The general concept of visually conveying digital data is known. For example, Quick Response (QR) Codes are now widely used to visually convey digital information to a receiving device. QR Codes are commonly found on advertisements in magazines, on signs, on product packaging, on posters and the like. Typically, the receiving device, such as a smart phone, captures the QR code by scanning the QR Code using a camera application. The information contained in the QR Code, that is, the content of the code itself, may be almost anything. For instance, the content may be a link to a webpage, an image, a location or a discount coupon. One benefit of using a QR Code, or other like codes, is that the information is transferred immediately to the receiving device. The most significant benefit, however, is that the digital information can be conveyed to the receiving device visually, as it does not require a network connection.

It is therefore possible to visually convey physical, real world information, in digital format, to an augmented reality device, in the manner described above, that is, without a network connection. If the quantity of data required to support a given augmented reality application is relatively small, a code, such as a QR code or other like codes, may be used as described above. However, augmented reality applications often require a significant amount of data, or a constant stream of data, where the amount of data far exceeds that which can possibly be conveyed using a single QR or other like code.

A video or video related application for use in an augmented reality device is an example of an application that might require a significant amount of data, or a constant stream of data. For instance, the video or video related application might require the digital data so that the augmented reality device can generate and/or display, sound, graphics, text or other supplemental information relating to and synchronized with the real-world video presentation (e.g., a movie or television program) being viewed by the user. If a network connection is available, conveying the quantity of data or the constant stream of data required is not a problem. What is needed is a system and method for conveying this quantity of data, or the constant stream of data, to support a video or video related augmented reality application when a network connection is not available.

SUMMARY OF THE INVENTION

The present invention obviates the aforementioned deficiencies associated with conveying digital data associated with a video or video related application for an augmented reality device, where the digital data cannot be conveyed over a network connection because a network connection is either unavailable or, for any number of reasons, it is undesirable to do so. In general, the present invention achieves this by encoding the data, inserting the encoded data into the video, on a frame-by-frame or on predefined frames, and therefore conveying the data visually to the augmented reality device. The augmented reality device, upon receiving the data, can then use the data to supplement the video (e.g., a movie, video clip, television program) that the user is watching to augment and therefore enhance the user's experience.

One advantage of the present invention is that it permits the augmented reality device to receive digital data without the use of a network connection.

Another advantage of the present invention is that it allows for the conveyance of a significant quantity of data, or a constant stream of data, which may be required to supplement the video that the user is watching Thus, in accordance with one aspect of the present invention, the above-identified and other advantages are achieved by a method of visually conveying digital data to an augmented reality device through video. The method involves inserting digital data into each of a plurality of video frames associated with the video. Accordingly, each of the plurality of video frames includes both video content and the inserted digital data. The method also involves displaying the video including each of the plurality of video frames such that the video including each of the plurality of video frames are available to be visually received by the augmented reality device, wherein the digital data represents data and/or information that supplements the video content.

In accordance with another aspect of the present invention, the above-identified and other advantages are achieved by a method of visually receiving digital data in an augmented reality device through video. The method involves visually capturing a plurality of video frames, wherein each of the plurality of video frames includes video content and digital data that has been inserted therein. The method also involves processing the digital data that was inserted into each of the plurality of visually received video frames and generating there from data and/or information that supplements the video content. The data and/or information that supplements the video content is then presented through the augmented reality device.

In accordance with still another aspect of the present invention, the above-identified and other advantages are achieved by an augmented reality device. The augmented reality device comprises a video sensor configured to visually capture video, wherein the video comprises a plurality of video frames, each including video content and digital data inserted therein. The augmented reality device also comprises a visual processor configured to process the digital data that was inserted into each of the plurality of visually received video frames and to generate there from data and/or information that supplements the video content. Still further, the augmented reality device comprises a rendering module configured to presenting, through the augmented reality device, the data and/or information that supplements the video content

BRIEF DESCRIPTION OF THE DRAWINGS

Several figures are provided herein to further the explanation of the present invention. More specifically.

DETAILED DESCRIPTION

It is to be understood that both the foregoing general description and the following detailed description are exemplary. As such, the descriptions herein are not intended to limit the scope of the present invention. Instead, the scope of the present invention is governed by the scope of the appended claims.

In accordance with exemplary embodiments of the present invention, digital data is inserted into video (e.g., a movie, a video clip, a television program) and visually conveyed to and received by an augmented reality device. The augmented reality device, upon processing the visually conveyed digital data, can then supplement the video to enhance the user's viewing experience. For example, if the video is a movie, the digital data may be used by the augmented reality device to display subtitles in the user's desired language, or display additional video, graphics or text. It may also be used to generate sound to further enhance the user's experience.

Further in accordance with exemplary embodiments of the present invention, a portion of each of a number of video frames (e.g., each and every video frame) can be encoded with the aforementioned data that the augmented reality device will receive, through visual means, process and use to supplement or enhance the video that is being viewed by the user. For purposes of illustration, the digital data may be conveyed by inserting a QR code into each of the video frames. One skilled in the art will appreciate that a QR code has a maximum binary capacity of 2,953 bytes. Therefore, video displaying two QR codes at 30 frames per second can visually convey (not taking error correction into consideration) over 177 kilobytes of digital data per second to the augmented reality device. This is not intended to suggest that the present invention is limited to the insertion of only two QR codes into each video frame. The number of QR codes would likely depend on the resolution of the camera and the processing capabilities of the augmented reality device. The higher the resolution and the greater the processing capability, the greater the number of QR codes that may be inserted into each video frame. One skilled in the art will also appreciate the fact that an error correction scheme would likely be used to insure the integrity of the data being visually conveyed. However, even with an error correction scheme, the amount of data that can be visually conveyed to the augmented reality device is substantial.

Figure 1:
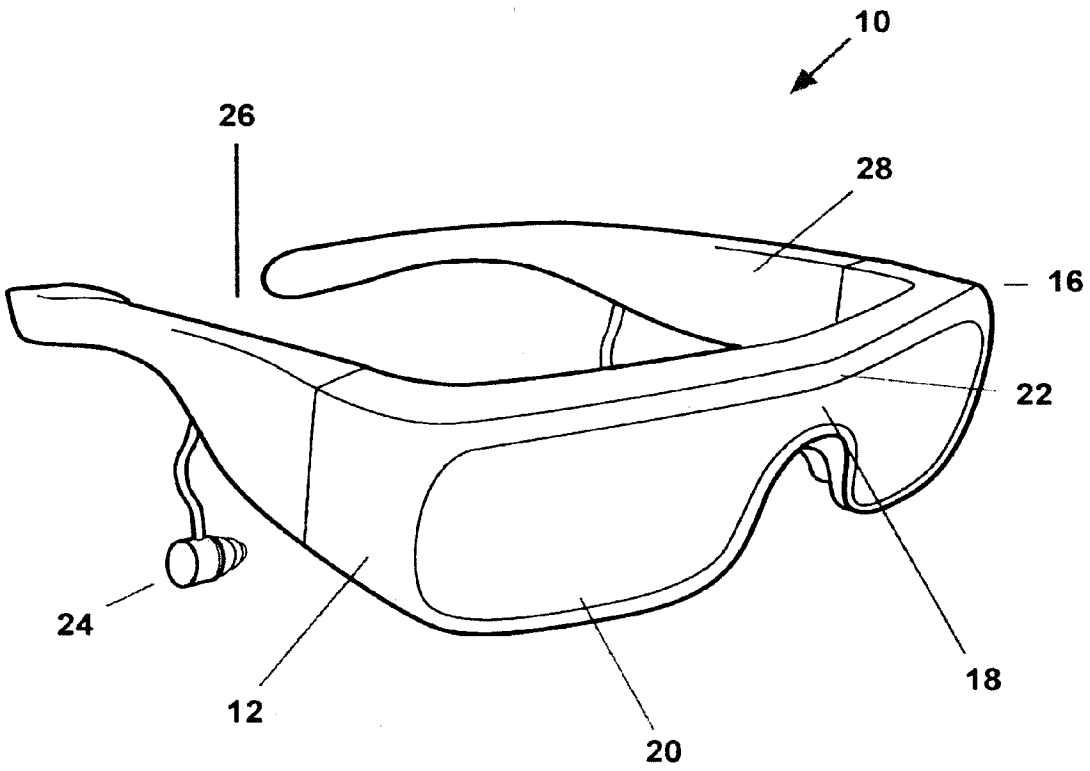
FIG. 1 illustrates an exemplary augmented reality device.

FIG. 1 illustrates an exemplary augmented reality device. At present, augmented reality glasses are the most common type of augmented reality device. It is certainly possible to use a smart phone as an augmented reality device. Therefore, it will be understood that the present invention is not limited to augmented reality glasses or any one type of augmented reality device. For example, a relatively simple augmented reality device might involve a projector with a camera interacting with the surrounding environment, where the projection could be on a glass surface or on top of other objects.

As shown in FIG. 1, the augmented reality glasses 10 include features relating to navigation, orientation, location, sensory input, sensory output, communication and computing. For example, the augmented reality glasses 10 include an inertial measurement unit (IMU) 12. Typically, IMUs comprise axial accelerometers and gyroscopes for measuring position, velocity and orientation. IMUs are employed by many mobile devices, as it is often necessary for mobile devices to know its position, velocity and orientation within the surrounding real world environment and/or its position, velocity and orientation relative to real world objects within that environment in order to perform its various functions. In the present case, the IMU may be employed if the user turns their head away such that the augmented reality glasses 10 cannot visually receive the digital data inserted into the video. The IMU knowing the relative position and orientation of the glasses may be able to instruct the user to reorient their head in order to begin visually receiving the digital data. IMUs are well known.

The augmented reality glasses 10 also include a Global Positioning System (GPS) unit 16. GPS units receive signals transmitted by a plurality of geosynchronous earth orbiting satellites in order to triangulate the location of the GPS unit. In more sophisticated systems, the GPS unit may repeatedly forward a location signal to an IMU to supplement the IMUs ability to compute position and velocity, thereby improving the accuracy of the IMU. In the present case, the augmented reality glasses may employ GPS to identify when the glasses are in a given location (e.g., a movie theater) where a video presentation having the inserted digital data is available. GPS units are also well known.

As mentioned above, the augmented reality glasses 10 include a number of features relating to sensory input and sensory output. Here, augmented reality glasses 10 include at least a front facing camera 18 to provide visual (e.g., video) input, a display (e.g., a translucent or a stereoscopic translucent display) 20 to provide a medium for displaying computer-generated information to the user, a microphone 22 to provide sound input and audio buds/speakers 24 to provide sound output. In a preferred embodiment of the present invention, the visually conveyed digital data would be received by the augmented reality glasses 10 through the front facing camera 18.

The augmented reality glasses 10 would likely have network communication capabilities, similar to conventional mobile devices, through the use of a cellular, WiFi, Bluetooth or tethered Ethernet connection. The augmented reality glasses 10 would likely have these capabilities despite the fact that the present invention provides for the visual conveyance and reception of digital data.

Of course, the augmented reality glasses 10 will also comprise an on-board microprocessor 28. The on-board microprocessor 28, in general, will control the aforementioned and other features associated with the augmented reality glasses 10. The on-board microprocessor 28 will, in turn, include certain hardware and software modules described in greater detail below.

Figure 2:
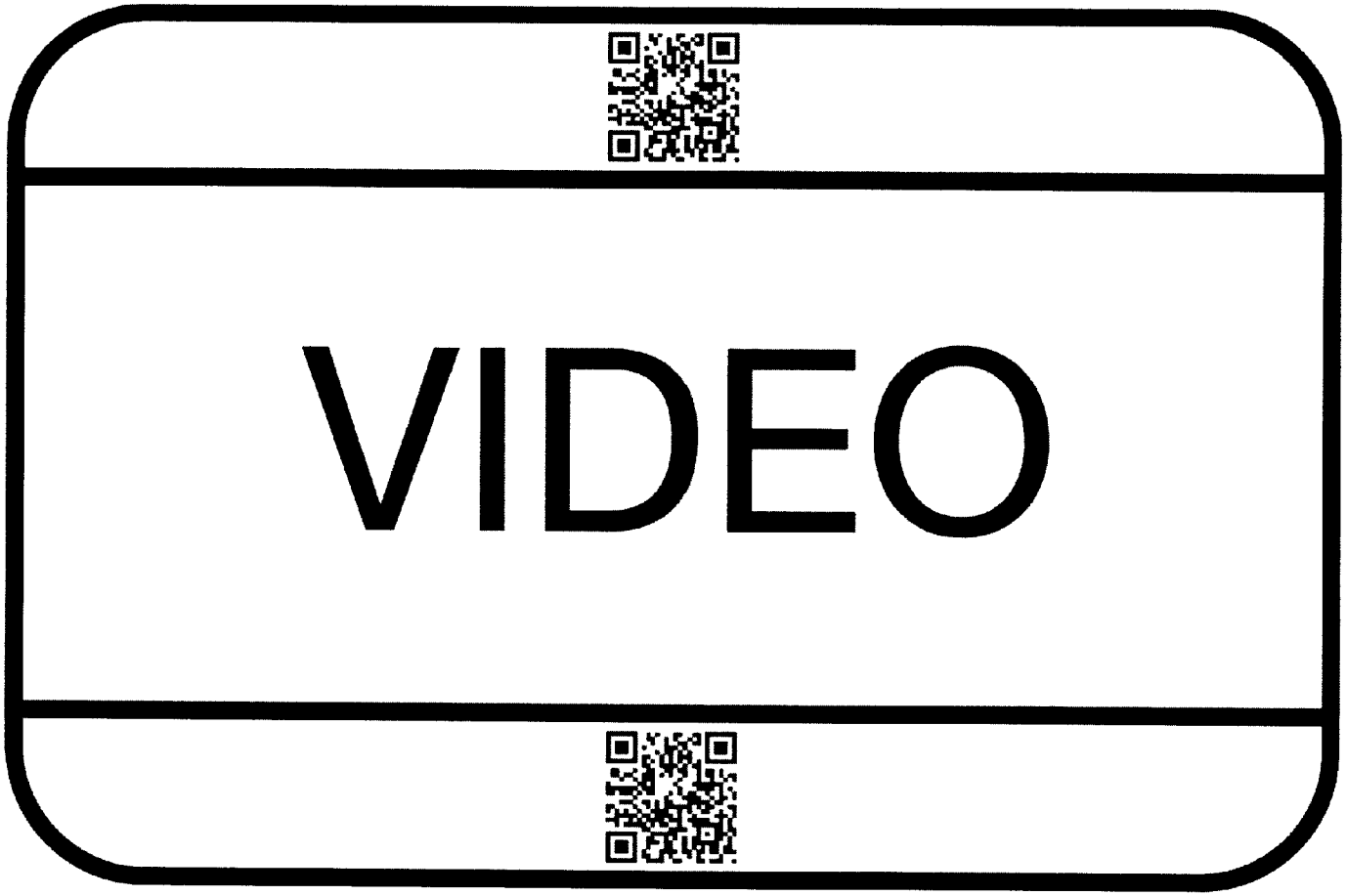
FIG. 2 is a first example of a video frame with additional digital data inserted therein, in accordance with exemplary embodiments of the present invention.
Figure 3:
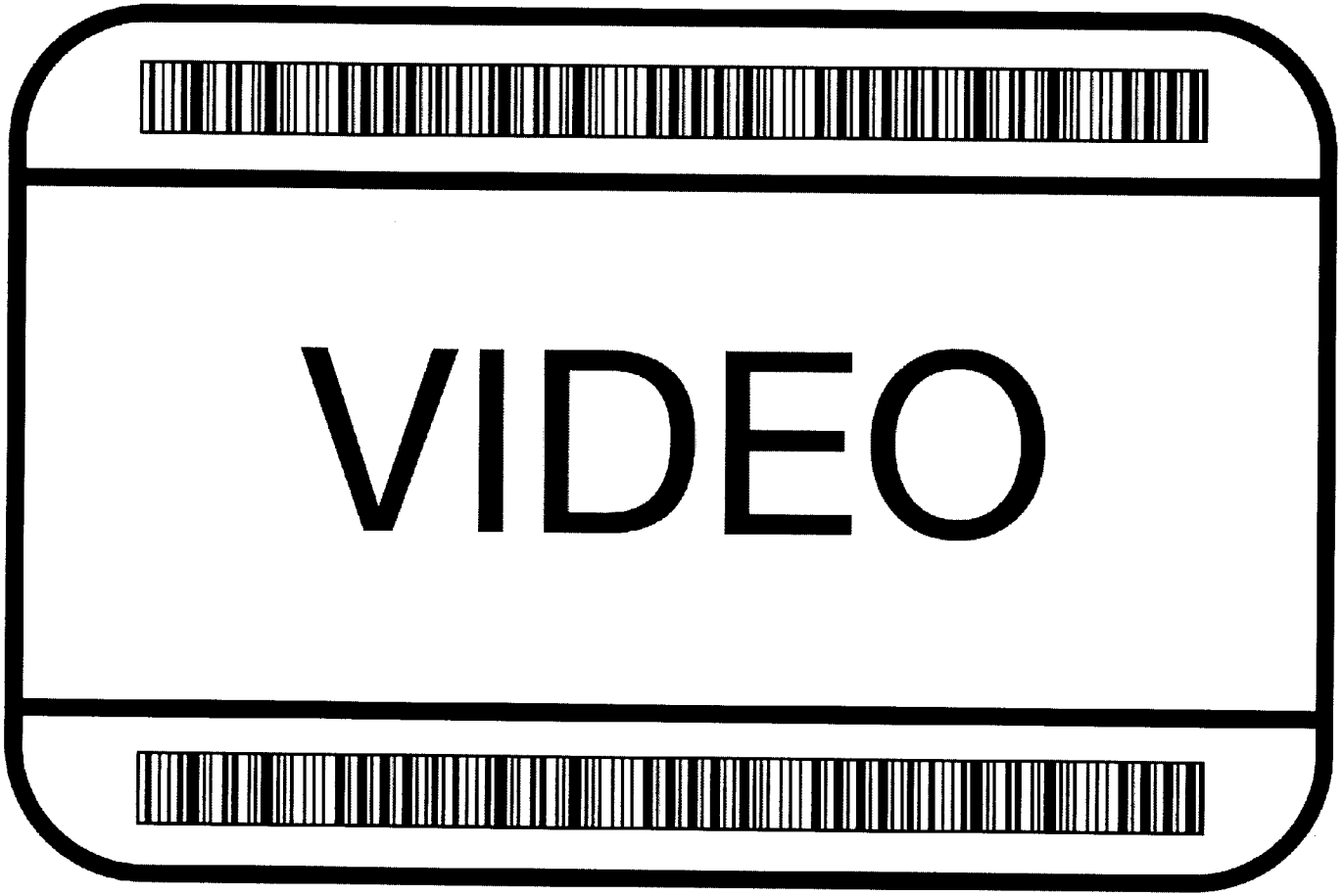
FIG. 3 is a second example of a video frame with additional digital data inserted therein, in accordance with exemplary embodiments of the present invention.
Figure 4:
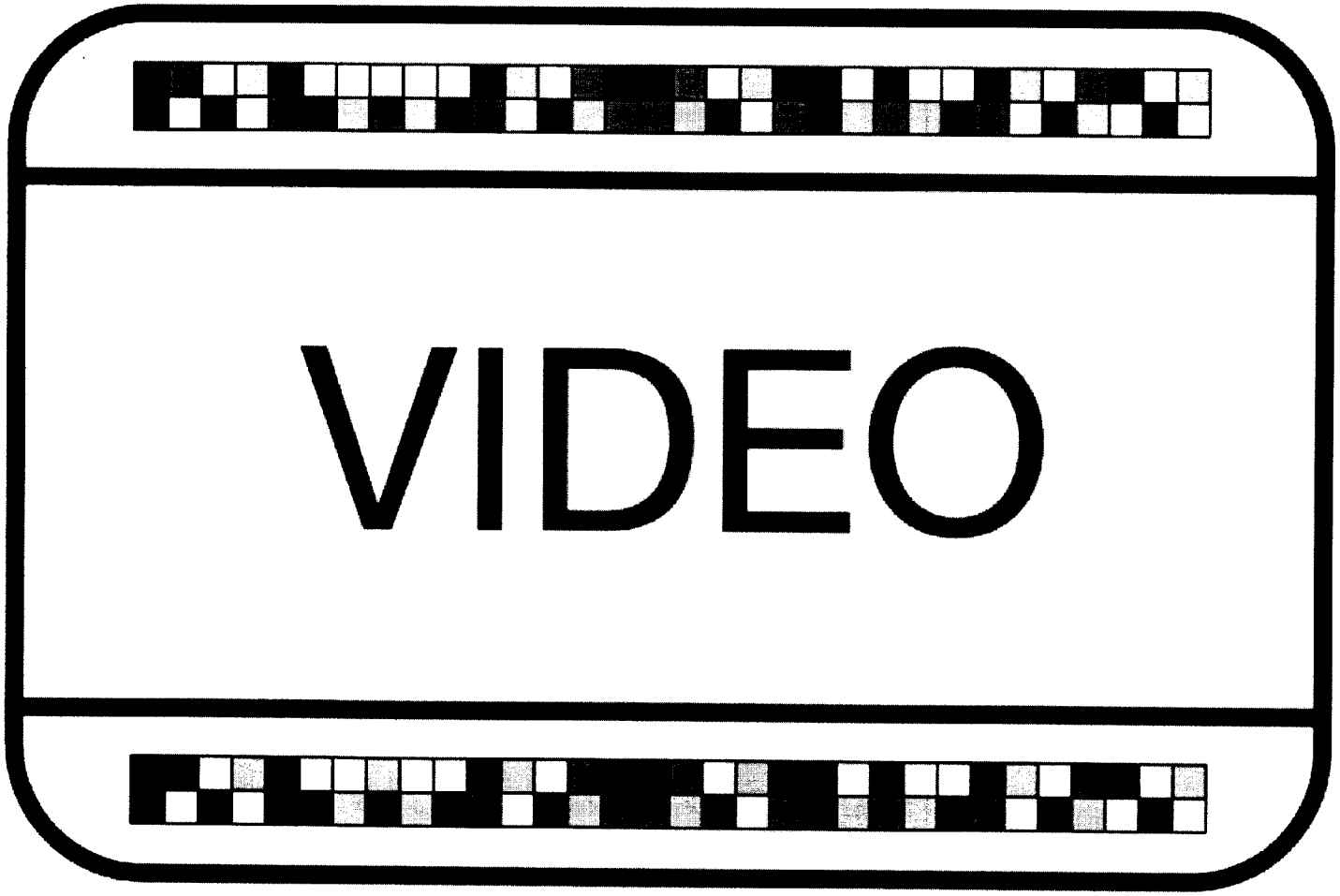
FIG. 4 is a third example of a video frame with additional digital data inserted therein, in accordance with exemplary embodiments of the present invention.

Each of FIGS. 2-4 illustrates a frame of video including digital data that is to be visually conveyed to an augmented reality device, such as augmented reality device 10. As one of ordinary skill in the art can see, the format of the digital data may vary. For example, in FIG. 2, the digital data that is to be visually conveyed to the augmented reality device is in the form of two QR codes. In FIG. 3, the digital data is in the form of a bar code. In FIG. 4, the digital data is in the form of a block pattern.

The positioning of the digital data in the video frame is not essential to the present invention. However, it is preferable that the digital data be positioned such that the user, watching the video, cannot see or, at least, is not or less likely to be distracted by the presence of the digital data. In each of the three exemplary embodiments illustrated in FIGS. 2-4, the digital data appears at the upper and lower edges of the video frame. It will be readily apparent that, in the alternative, the digital data may appear only at the upper edge or only at the lower edge of the video frame. It will also be readily apparent that the digital data may appear at any peripheral portion or portions of the video frame, further including the right and/or left edges of the video frame. At least in the case of the QR code, the digital data may appear in one or more corners of the video frame.

Figure 7:
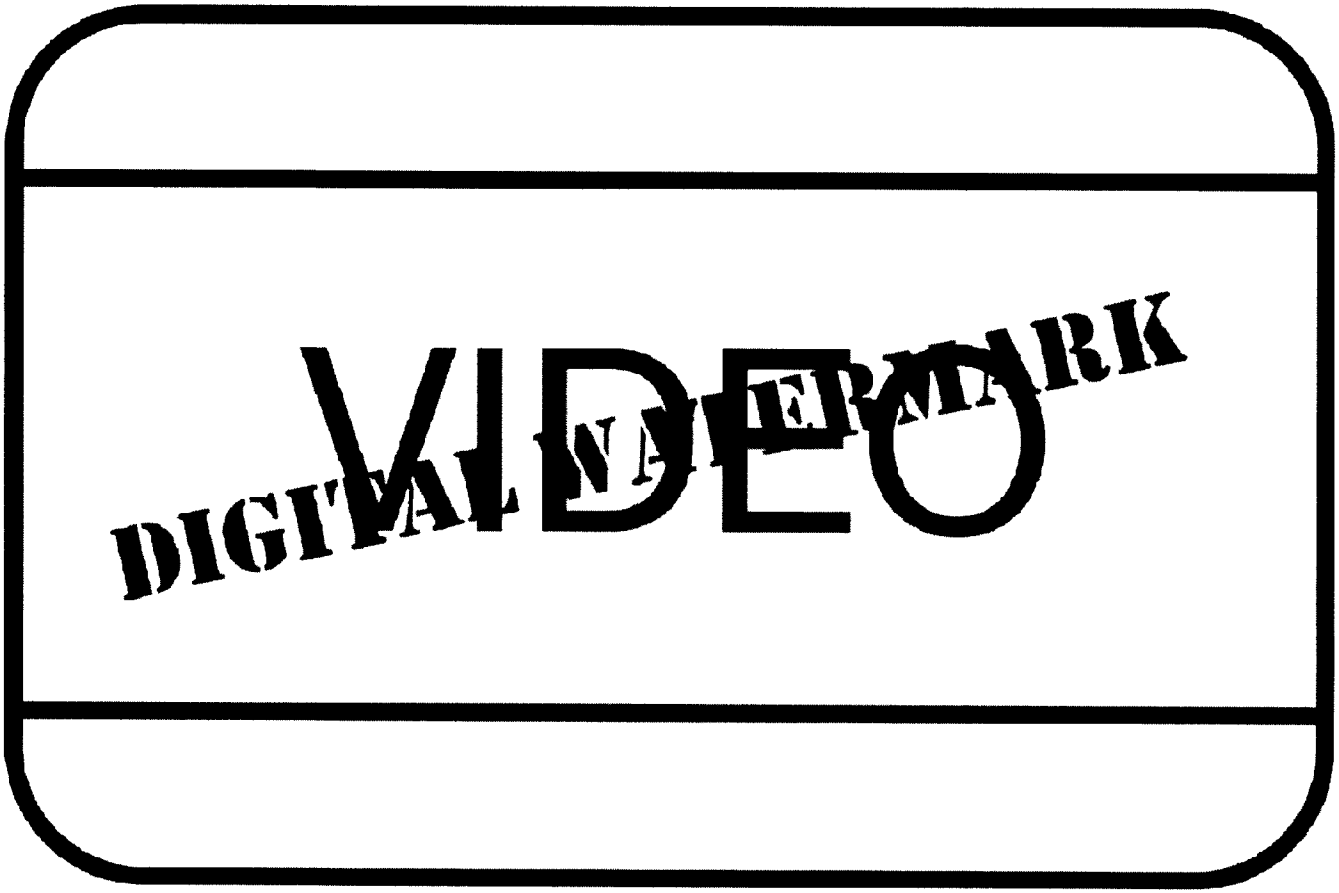
FIG. 7 is a fourth example of a video frame with additional digital data inserted therein, in accordance with exemplary embodiments of the present invention.

In still another exemplary embodiment as shown in FIG. 7, the digital data may be integrated into the video itself, where an application running on the augmented reality device would have the capability to recognize and extract the digital data from the video content, and where the digital data is distributed within the video such that the user with their naked eye cannot detect it. In this exemplary embodiment, the technique of watermarking may be employed to encode the digital data so that that it can be inserted into the video content and, thereafter, extracted from the video and processed accordingly.

The bandwidth at which the digital data is visually conveyed also may vary. As mentioned above, absent any error correction scheme, the presentation of two different QR codes in each video frame, at 30 frames per second can visually convey over 177 kilobytes of digital data per second to the augmented reality device. Likewise, the bar codes and block codes illustrated in FIG. 3 and FIG. 4, respectively, may completely change from one video frame to the next or, alternatively, the bar and block codes may gradually change from one video frame to the next, for example, giving the appearance the bar or block codes are scrolling right or scrolling left. It will be understood, as suggested above, that the actual amount of digital data that is visually conveyed will depend on several factors including the amount of digital data included in each video frame, the capability of the augmented reality device to capture the quantity of data being conveyed and the capability of the processor in the augmented reality device to process the digital data and use it to supplement the video.

Figure 5:
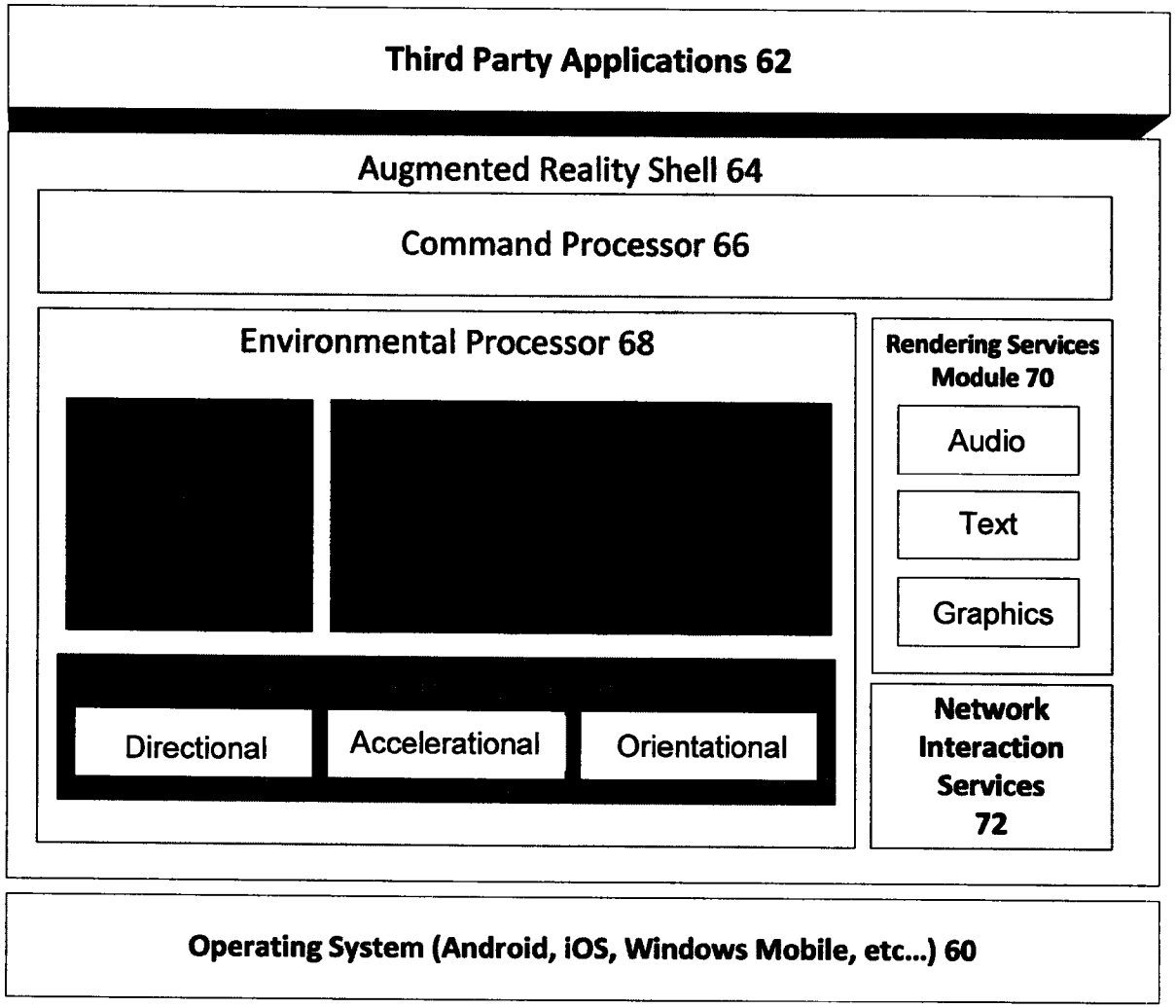
FIG. 5 is a system block diagram illustrating the configuration of certain functional modules and/or components residing in the processor, in accordance with exemplary embodiments of the present invention.

FIG. 5 is a system block diagram illustrating the configuration of certain functional modules and/or components residing in the processor, in accordance with exemplary embodiments of the present invention. As illustrated, the modules and/or components are configured into three layers, although this is not intended to be limiting in any way. At the lowest layer is the operating system 60. The operating system 60 may, for example, be an Android based operating system, an iPhone based operating system, a Windows Mobile operating system or the like. At the highest layer is the third party application layer 62. Applications that are designed to work with the operating system 60 that either came with the augmented reality device or were loaded by the user reside in this third layer. The middle layer is referred to as the augmented reality shell 64.

The augmented reality shell 64, as shown, includes a number of components including a command processor 68, and environmental processor 72, a rendering services module 69 and a network interaction services module 70. It is will be understood that each of the functional modules and/or components may be hardware, software, firmware or a combination thereof. A brief description of each will now follow.

The environmental processor 72, in general, monitors the surrounding, real world environment of the augmented reality device based on input signals received and processed by the augmented reality device. The environmental processor 72 may be implemented, as shown in FIG. 5, similar to the other processing components, or it may be implemented separately, for example, in the form of an application specific integrated chip (ASIC). In accordance with a preferred embodiment, the environmental processor 72 is running whenever the augmented reality mobile device is turned on.

The environmental processor 72, in turn, also includes several processing modules: a visual processing module 74, a geolocational processing module 78 and a positional processing module 80. The visual processing module 74 is primarily responsible for processing the received video, detecting and decoding the frames and processing the digital data included with the video that was visually conveyed to the augmented reality device.

The geolocational module 78 receives and processes signals relating to the location of the augmented reality mobile device. The signals may, for example, reflect GPS coordinates, the location of a WiFi hotspot, or the proximity to one or more local cell towers. As explained above, the geolocational processing module 78 may play a role in the present invention by notifying the augmented reality device when it is in a location where a video application may be used (e.g., a movie theater).

The positional processing module 80 receives and processes signals relating to the position, velocity, acceleration, direction and orientation of the augmented reality mobile device. The positional processing module 80 may receive these signals from an IMU (e.g., IMU 12). The positional processing module 80 may, alternatively or additionally, receive signals from a GPS receiver, where it is understood that the GPS receiver can only approximate position (and therefore velocity and acceleration) and where the positional processing module 80 can then provide a level of detail or accuracy based on the GPS approximated position. Thus, for example, the GPS receiver may be able to provide the general GPS coordinates of a movie theater, but the positional processing module 80 may be able to provide the user's orientation within the movie theater. The positional processing module 80 may be employed in conjunction with the visual processing module 74 to synchronize user head movements with viewing experiences (e.g., what the rendering services module 69 will render on the display and, therefore, what the user sees). Also, as stated above, the positional processing module 80 may be used to determine if and when the user has moved their head away from the video being presented, thus aiding in the determination whether and why synchronization has been lost (i.e., the augmented reality device is no longer receiving video and, more particularly, the digital data).

In addition to the environmental processor 72, the augmented reality shell 64 includes a command processor 68 and a rendering services module 69. The command processor 68 processes messaging between the modules and/or components. For example, after the visual processing module 74 processes the digital data that was visually received through the video, the visual processing module 74 communicates with the command processor 68 which, in turn, generates one or more commands to the rendering services module 69 to produce the computer-generated data (e.g., text, graphics, additional video, sound) that will be used to supplement the video and enhance the user's viewing experience.

The rendering services module 69. This module provides a means for processing the content of the digital data that was visually received and, based on instructions provided through the command processor 68, generate and present (e.g., display) data in the form of sound, graphics/animation, text, additional video and the like. The user can thus view the video and, in addition, experience the computer-generated information to supplement the video and enhance the viewing experience.

Figure 6:
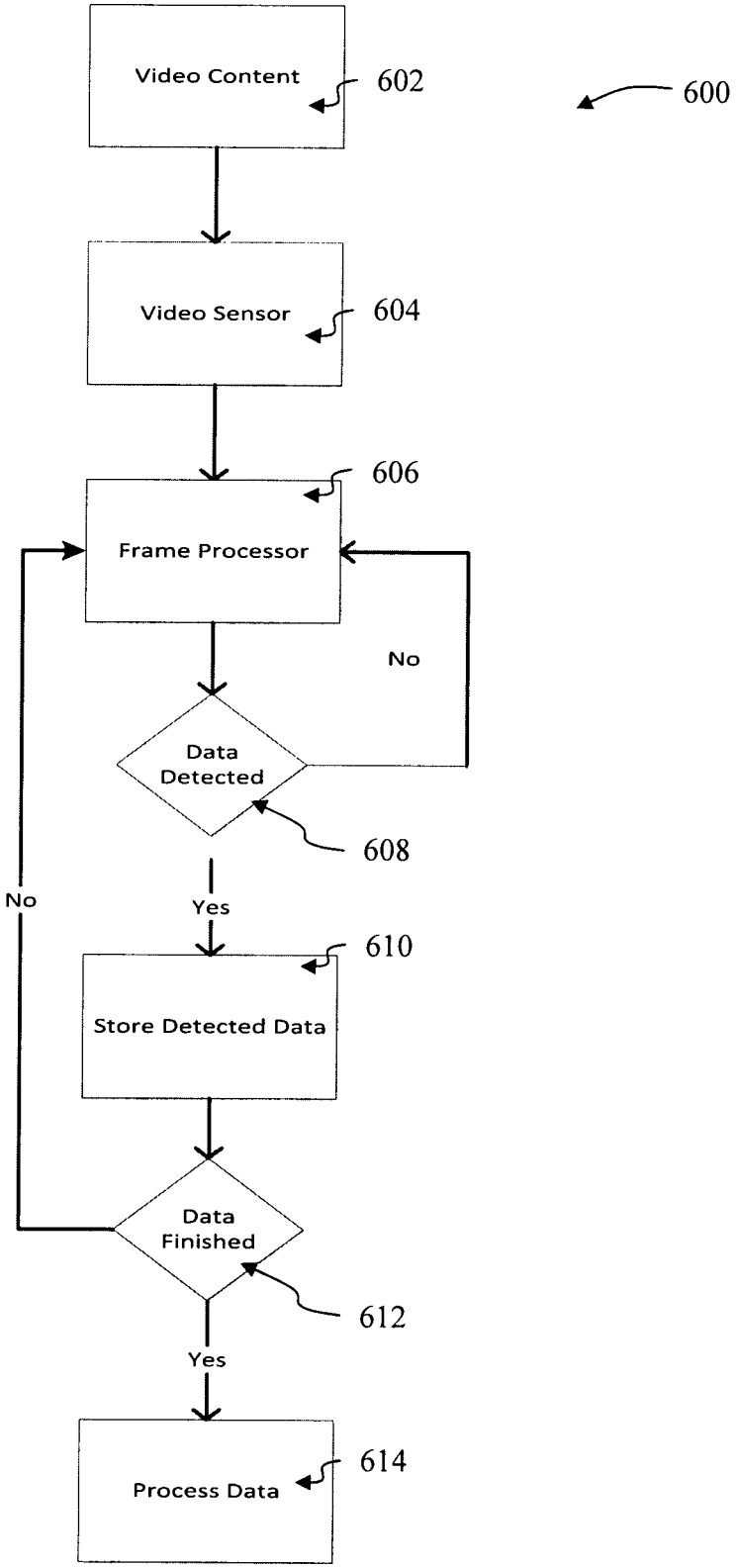
FIG. 6 is a flowchart illustrating a method of visually conveying and receiving digital data for an augmented reality device, in accordance with exemplary embodiments of the present invention.

FIG. 6 is a flowchart that illustrates the general method 600 associated with visually conveying digital data to and visually receiving digital data in an augmented reality device through video, in accordance with exemplary embodiments of the present invention. The method will be described herein with reference back to the functional modules and/or components of FIG. 5.

The general method 600 begins, of course, with the inclusion of digital data into a sequence of video frames associated with the corresponding video. This results in a video feed, as indicated by step 602, comprising a plurality of video frames, where each of the plurality of video frames includes the video content and the additional digital data that the augmented reality device will ultimately use to provide computer-generated data and/or information, supplement the video and enhance the user's viewing experience. It will be understood that the digital data may be included in each and every video frame or fewer than each and every video frame. As stated above, the amount of digital data that is visually conveyed may be limited by the bandwidth associated with the augmented reality device's camera and processing capabilities. It will also be understood that the manner in which the digital data is positioned within the video frame or integrated into the video content itself may vary, as explained above The video feed may be displayed on anything from a television, a movie theater screen, a mobile device, a wall projection, or any other medium. Furthermore, the frame rate of the video is not particularly relevant here, nor are the dimensions of the medium on which the video is being displayed. The primary issue is that there is a series of encoded video frames, a plurality of which, include the additional digital data as explained above, which a video sensor associated with the augmented reality device can detect and pass to a frame processor, as explained herein below. Once the frame processor detects and stores the digital data, the system can process the data.

If a user is viewing the video with an augmented reality device, such as augmented reality device 10, a video sensor in the augmented reality device will capture the video and the digital data inserted therein, and convert the all of the received data back into a plurality of video frames for further processing, as indicated by step 604. In augmented reality device 10, the video sensor is the front facing camera 18.

As stated above, the captured video data, including the additional digital data, in the form of a plurality of video frames is passed on to a frame processor (not shown), as shown in step 606. The frame processor, in a preferred embodiment of the present invention, is implemented in the visual processing module 74. The primary function of the frame processor is to detect the presence of the digital data that is included with the video content, as shown by decision block 608. If, in accordance with the NO path out of decision block 608, the frame processor detects no digital data in a given video frame, the frame processor moves to the next frame and repeats the process. If, however, the frame processor does detect digital data in a given video frame, it will store the detected digital data, as shown in step 610. This is somewhat analogous to downloading data as the viewer is watching the video content. The frame processor then determines whether there are more video frames to analyze, as shown by decision step 612. If, in accordance with the YES path out of decision step 612, there are further video frames to analyze, the frame processor returns to step 606, and the method continues. If, instead, the frame processor determines there are no further video frames to analyze, in accordance with the NO path out of decision step 612, then all of the detected digital data will have been stored and the digital data can now be further analyzed, as shown by step 614, by the visual processing module 74. As explained above, the further analysis may involve determining the content of the digital data and, through the command processor 66, instruct the rendering services module 70 to provide computer-generated data and/or information in the form of text, graphics, animation, additional video, sound, to supplement the video and enhance the user's viewing experience.

In an alternative embodiment, the visual processing module 74 may further analyze the stored digital data as soon as the frame processor begins storing the digital data in memory. In other words, the frame processor may continue to analyze frames of video, detect any digital data contained therein, and store detected digital data while in parallel the other functions associated with the visual processing module 74 are analyzing digital data that has already been detected and stored by the frame processor.

With reference back to decision block 608, the frame processor may detect the presence of digital data through the use of markers. Such markers may, for example, be predefined data patterns or subtle color patterns. The markers may or may not be visible to the naked eye. However, the markers are recognizable by the frame processor. A marker may be included with the digital data at or near the edge or edges of the video frame or integrated into the video content itself, as explained above. Further, start and end markers may be employed, where the presence of an end marker would permit the frame processor to determine whether there is further digital data to detect and store, pursuant to decision step 612.

As mentioned previously, there are many possible applications for the present invention. To summarize, such applications may involve, for example, closed captioning, where the augmented reality device, such as augmented reality glasses 10, detects video frames that contain digital data reflecting closed captioning information that is ultimately displayed to the user while watching a television program or a movie. The application may involve subtitles that provide translation into a desired language or simply additional information that might be of interest to the user. The application may involve censorship, where the digital data may reflect information as to where the augmented reality device should place censor overlays on objectionable material. The application may involve intelligent advertising, where coupons and other items may be delivered or downloaded upon successful viewing of the advertisement video or by selecting an icon presented to the user through the display of the augmented reality device. And, as previously mentioned, the application may involve synchronized augmented reality movie content, wherein during a movie, additional content (e.g., in the form of additional and supplemental video, graphics and/or animation) may be displayed for the user in synchronicity with the video content, and wherein the additional content may or may not be restricted to the screen or viewing medium of the video. This last point is particularly significant as it distinguishes over present 3D techniques that are limited to presenting 3D content to the dimensions of the display screen or viewing medium. Thus, for example, a computer-generated image of a bird might appear to be flying around the room or theater because it is actually being projected on the display of the augmented reality device. The image would be unique to the perspective of that user based on the position of his or her head. This list of exemplary applications is not, however, intended to be limiting.

The present invention has been described above in terms of a preferred embodiment and one or more alternative embodiments. Moreover, various aspects of the present invention have been described. One of ordinary skill in the art should not interpret the various aspects or embodiments as limiting in any way, but as exemplary. Clearly, other embodiments are well within the scope of the present invention. The scope the present invention will instead be determined by the appended claims.

We claim:

1. A method of conveying digital data to an augmented reality device through external video, the method comprising:

encoding digital data into each of a plurality of video frames associated with the external video, such that each of the plurality of video frames includes both viewable video content and the encoded digital data;

displaying the external video externally from the augmented reality device including each of the plurality of video frames such that the external video including each of the plurality of video frames is available to be visually sensed and captured by the augmented reality device, wherein the digital data represents data and/or information that is included with the viewable video content and visually detectable by the augmented reality device, and wherein the digital data is encoded within the external video such that a user with their naked eye cannot detect it.

2. The method of claim 1, wherein encoding digital data into each of a plurality of video frames associated with the external video comprises:

integrating the digital data with the viewable video content.

3. The method of claim 1, wherein encoding digital data into each of a plurality of video frames associated with the external video comprises:

encoding the digital data as one or more codes into one or more peripheral portions of each of the plurality of video frames.

4. The method of claim 3, wherein encoding the digital data as one or more codes into one or more peripheral portions of each of the plurality of video frames comprises:

encoding the digital data as one or more QR codes.

5. The method of claim 3, wherein encoding the digital data as one or more codes into one or more peripheral portions of each of the plurality of video frames comprises:

encoding the digital data as one or more bar codes.

6. The method of claim 3, wherein encoding the digital data as one or more codes into one or more peripheral portions of each of the plurality of video frames comprises:

inserting the digital data as one or more block codes.

7. The method of claim 1, wherein encoding digital data into each of a plurality of video frames associated with the video comprises:

encoding digital data into each and every video frame associated with the external video.

8. The method of claim 1 further comprising:

encoding into at least one video frame associated with the external video, a first marker indicating the presence of the digital data in the plurality of video frames.

9. The method of claim 8 further comprising:

encoding into at least one video frame associated with the external video, a second marker, wherein the first marker further indicates a first one of the plurality of video frames containing the digital data, and wherein the second marker indicates a last one of the plurality of video frames containing the digital data.

10. The method of claim 1, wherein inserting digital data into each of a plurality of video frames associated with the external video comprises:

encoding different digital data into each of the plurality of video frames.

11. A method of receiving digital data in an augmented reality device through external video, the method comprising:

visually capturing a plurality of video frames of the external video, wherein each of the plurality of video frames includes viewable video content displayed externally from the augmented reality device and digital data that has been encoded therein and visually detectable by the augmented reality device;

processing the digital data encoded into each of the plurality of visually captured video frames and generating therefrom data and/or information that is included with the viewable video content; and presenting, through the augmented reality device, the data and/or information that is included with the viewable video content, wherein the digital data is encoded within the external video such that a user with their naked eye cannot detect it.

12. The method of claim 11 further comprising:

detecting the digital data in each of the plurality of video frames; and storing the digital data in memory.

13. The method of claim 11, wherein the plurality of video frames containing the digital data is less than all of the video frames associated with the external video, the method further comprising:

capturing video frames that contain the digital data and capturing video frames that do not contain the digital data; and determining which video frames contain the digital data based on a first predefined marker indicating the presence of the digital data.

14. The method of claim 13, wherein determining which video frames contain the digital data based on a second predefined marker, the first marker indicating a first video frame containing the digital data and the second marker indicating a last video frame containing data.

15. The method of claim 13, wherein each of the plurality of video frames containing digital data include a marker indicating the presence of the digital data.

16. The method of claim 11, wherein presenting, through the augmented reality device, the data and/or information that is included with the viewable video content comprises:

rendering the data and/or information that is included with the viewable video content on a display of the augmented reality device.

17. The method of claim 16, wherein the data and/or information is text.

18. The method of claim 16, wherein the data and/or information is graphics.

19. The method of claim 16, wherein the data and/or information is animation.

20. The method of claim 16, wherein the data and/or information is additional video.

21. The method of claim 11, wherein presenting, through the augmented reality device, the data and/or information that is included with the viewable video content comprises:

reproducing sound through a sound reproduction component of the augmented reality device.

22. The method of claim 11, wherein presenting, through the augmented reality device, the data and/or information that is included with the viewable video content comprises:

downloading the data/information into the augmented reality device over a network connection.

23. An augmented reality device comprising:

a video sensor configured to visually capture external video, wherein the external video comprises a plurality of video frames, each including viewable video content displayed externally from the augmented reality device and digital data encoded therein that is visually detectable by the augmented reality device;

a visual processor configured to process the digital data that was encoded into each of the plurality of captured video frames and to generate therefrom data and/or information; and a rendering module configured to present, through the augmented reality device, the data and/or information, wherein the digital data is encoded within the video such that a user with their naked eye cannot detect it.

24. The augmented reality device of claim 23, wherein the video sensor is a camera.

25. The augmented reality device of claim 23, wherein the plurality of video frames containing the digital data is less than all of the video frames associated with the external video, and wherein the visual processor is further configured to capture video frames that contain the digital data, capture video frames that do not contain the digital data, and determine which video frames contain the digital data and which video frames do not contain the digital data based on a predefined marker indicating the presence of the digital data.

26. The augmented reality device of claim 25, wherein the visual processor is further configured to determine which video frames contain the digital data and which video frames do not contain the digital data based on a second predefined marker, the predefined marker indicating a first video frame containing the digital data and the second predefined marker indicating a last video frame containing data.

27. The augmented reality device of claim 25, wherein the visual processor is further configured to determine which video frames contain the digital data and which video frames do not contain digital data by detecting the predefined marker in each of the plurality of video frames that contain the digital data.

28. The augmented reality device of claim 23 further comprising a display, and wherein the rendering module is further configured to render the data and/or information on the display of the augmented reality device.

29. The augmented reality device of claim 28, wherein the data and/or information is text.

30. The augmented reality device of claim 28, wherein the data and/or information is graphics.

31. The augmented reality device of claim 28, wherein the data and/or information is animation.

32. The augmented reality device of claim 28, wherein the data and/or information is additional video.

33. The augmented reality device of claim 23 further comprising a sound reproduction component, wherein the rendering module is further configured to reproduce sound through the sound reproduction component.

34. The augmented reality device of claim 23 further comprising a network services interaction module configured to provide a network connection for the augmented reality device, over which, the data and/or information that is included with the viewable video content is downloaded.

* * * * *